US007086546B2

(12) United States Patent
Meier

(10) Patent No.: US 7,086,546 B2
(45) Date of Patent: Aug. 8, 2006

(54) CLAMP

(76) Inventor: Roger L. Meier, 4075 Rivercrest Dr. North, Salem, OR (US) 97303

( * ) Notice: Subject to any disclaimer, the term of this patent is extended or adjusted under 35 U.S.C. 154(b) by 0 days.

(21) Appl. No.: 11/167,977

(22) Filed: Jun. 27, 2005

(65) Prior Publication Data

US 2005/0236350 A1 Oct. 27, 2005

Related U.S. Application Data

(62) Division of application No. 10/377,227, filed on Feb. 27, 2003, now Pat. No. 6,910,590.

(51) Int. Cl.
*A47F 5/00* (2006.01)
*B25G 3/20* (2006.01)

(52) U.S. Cl. ..... 211/374.5; 403/374.5

(58) Field of Classification Search ..... 248/226.11, 248/231.85, 228.6, 207, 227.3, 200, 316.1, 248/214, 218.4, 219.1, 220.21, 229.2–229.21, 248/228.2; 211/183; 70/19, 223; 297/440.21, 297/440.16; 292/137, 179, 150, 292, 295, 292/302, DIG. 54; 403/DIG. 8, 374.5, 399
See application file for complete search history.

(56) References Cited

U.S. PATENT DOCUMENTS

| | | | | |
|---|---|---|---|---|
| 2,897,013 | A * | 7/1959 | Delp | 52/645 |
| 3,163,911 | A * | 1/1965 | Kenney | 249/41 |
| 3,716,896 | A | 2/1973 | Seabourn et al. | |
| 5,339,969 | A * | 8/1994 | Filipowski | 211/189 |
| 5,616,036 | A | 4/1997 | Polidori | |
| 5,692,273 | A | 12/1997 | Rodde | |

FOREIGN PATENT DOCUMENTS

JP 7017410 1/1995

* cited by examiner

*Primary Examiner*—Richard E. Chilcot, Jr.
*Assistant Examiner*—Lindsay M. Maguire
(74) *Attorney, Agent, or Firm*—Chernoff, Vilhauer, McClung & Stenzel, L.L.P.

(57) ABSTRACT

A method and a display rack apparatus for the efficient display of large or bulky inventory items. The display rack includes mounting brackets attached to sloping lateral frame arms to support similar parts of disassembled items of inventory in an inclined, raised array. The mounting brackets grip the frame arms by pressure of cam pins and may include associated fingers shaped to engage the parts being displayed.

8 Claims, 7 Drawing Sheets

CLAMP

CROSS-REFERENCE TO RELATED APPLICATION

This application is a division of U.S. patent application Ser. No. 10/377,227, filed Feb. 27, 2003, now U.S. Pat. No. 6,910,590.

BACKGROUND OF THE INVENTION

The present invention relates to a method and apparatus for the efficient display of inventory items that are large or awkward to handle when fully assembled.

Retailers have limited floor space in which to display their merchandise; hence they must use that space as efficiently as possible. The efficient usage of display floor space becomes problematic when displaying a representative assortment of inventory items that are large or bulky, such as furniture items, bicycles, etc. Exacerbating this problem is that fact that many models of such items are manufactured in a wide variety of colors or designs. For example, a single model of a reclining chair may be offered in units having an assortment of both color and upholstery variations.

Traditionally, retailers would simply display these bulky inventory items on a retail floor next to one another, so that customers could easily browse the retailer=s inventory and select a preferred unit. Unfortunately, with a limited amount of space, it is often not feasible to display every available color or design for each model, which may result in a missed sale.

An alternate method of displaying bulky inventory items uses a display rack or other structure to stack bulky inventory items above one another, thus utilizing vertical space as well as horizontal space. One example of such a display rack is disclosed by Thompson, U.S. Pat. No. 2,713,424. Though such display racks utilize floor space somewhat more efficiently than simply displaying bulky items on a retail floor, frequently there is still insufficient space to display all the units that a retailer might desire. Furthermore, many of these bulky items are heavy and require a great deal of effort to lift onto, or off from, the display rack. Also, once such a rack is fully loaded, it is frequently difficult to move it around to make room for additional items.

What is needed, then, is a method or apparatus for efficiently displaying inventory items that are large or bulky, in such a way as to display many different color or design choices of a product using as little floor space as is feasible. It is further desired that the method or apparatus permit displayed items to be positioned or moved with little effort.

SUMMARY OF THE INVENTION

The present invention avoids some of the previously mentioned inefficiencies of existing inventory displays by providing a novel inventory display and a method for its use that exploits the fact that many large inventory items are either shipped to the retailer in a disassembled condition or may easily be disassembled after delivery.

As a first aspect, the present invention provides a display rack including a frame having a pair of parallel upwardly sloping lateral arms and at least a pair of mounting brackets, each mounting bracket being adapted to be engaged with a respective side of an item to be displayed and each mounting bracket being fastened to a respective one of the lateral arms.

As a second aspect of the invention, each mounting bracket includes a channel fitting around the respective one of the lateral arms and having opposite sides defining a pair of coaxially aligned bores, and an associated clamp mechanism includes an engagement member such as a cam pin extending through the bores from one of the sides to the other. The cam pin is rotatable in the bores, between a released position in which space is provided between the cam pin and such a lateral arm in the channel, and a fastening position in which a surface of the cam pin is closer to the interior of the channel and presses upon a surface of an article within the channel, such as a lateral arm of the frame of the display rack, forcing the article into contact with the interior of the channel and thus clamping the mounting bracket to the article within the channel so as to hold the mounting bracket in a desired position with respect to the article in the channel.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
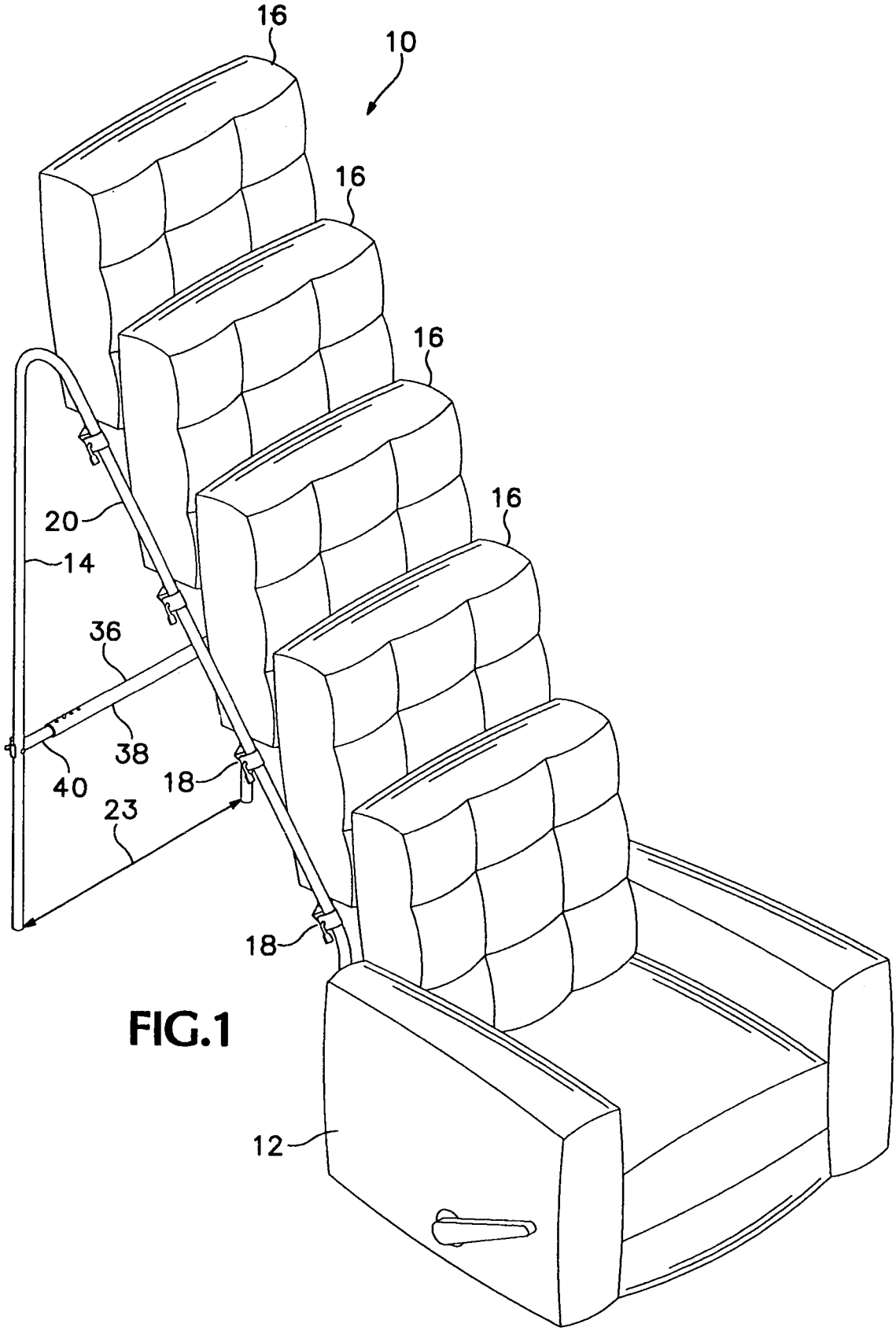
FIG. 1 is an isometric view of an inventory display that utilizes the present invention, showing an inventory item in front of a display rack with multiple similar portions of inventory items mounted on the display rack.

Referring to the drawings that form a part of the disclosure herein, FIG. 1 shows an inventory display 10 that includes one preferred embodiment of the present invention. The inventory display 10 includes an assembled recliner chair 12, the floor model of an inventory item having large dimensions, making it awkward to move. Behind the recliner chair 12 is a display rack 14 that supports an upwardly inclined array of several backs 16 of disassembled chairs similar to that of the recliner chair 12, portions of disassembled items of an inventory. Other embodiments of the display rack may be designed to display several similar portions of other types of inventory items. The similar portions of disassembled inventory items may be portions such as tabletops, frames of bicycles, etc. Each of the similar chair backs 16 of disassembled recliner chairs 12 shows, for example, a different available color, cover material, or decorative design for the recliner chair 12. In this manner, the necessity of displaying a fully assembled unit of each stocked color or design is avoided, while customers browsing through a retailer's inventory will still be able to quickly identify whether an inventory item is available in the color or design desired. It should be understood, then, that the inventory display rack 14 may be suitable for displaying a wide variety of inventory items such as assorted furniture items, bicycles, etc. Furthermore, a larger variety of disassembled portions may be displayed by using two such inventory displays positioned in a back-to-back relationship.

In addition to utilizing space more efficiently, the inventory display 10 is far easier to manage than previously existing inventory displays because the similar portions 16 of disassembled units of an inventory item are smaller, less awkward to handle, and weigh less than the corresponding completely assembled items. Thus the separate portions such as chair backs 16 may be more easily mounted on, or removed from, the inventory display rack 14 than from previously existing inventory displays. In addition, the inventory display 10 may be more easily moved should it be desired to rearrange displays on a retail floor.

Figure 2:
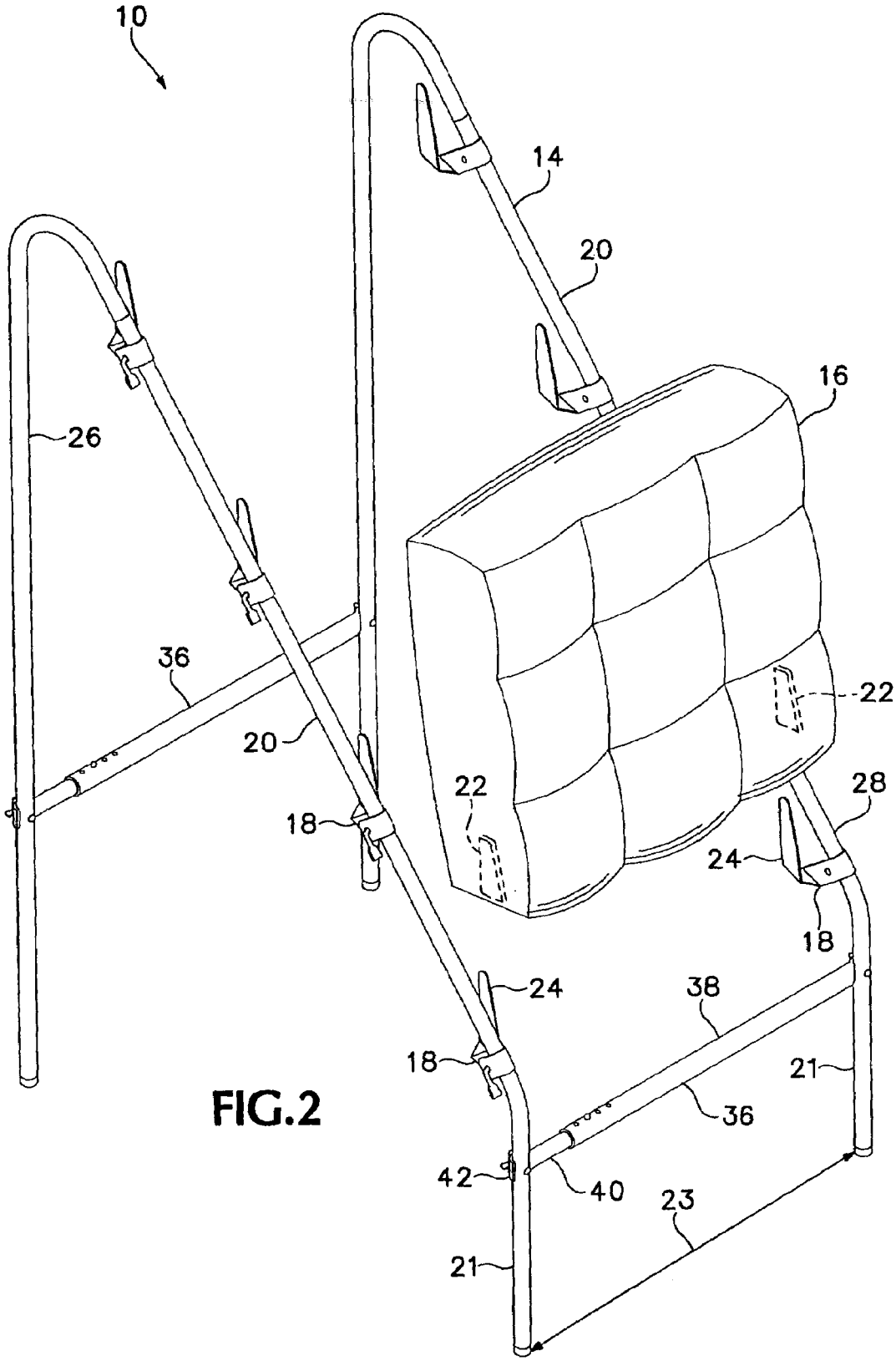
FIG. 2 is an isometric view of the display rack depicted in FIG. 1 showing the manner in which a portion of a disassembled item of inventory may be supported on mounting brackets fastened to the frame of the display rack.

Referring to FIG. 2, the display rack 14 includes a pair of parallel lateral arms 20 to which mounting brackets 18 are secured. Both lateral arms 20 preferably slope in an upward and rearward direction, away from vertical lower leg portions 21, shown alongside the recliner chair 12. Each chair back 16 is supported separately in a raised array close to the complete chair 12, so that each may be independently seen by customers.

Figure 5:
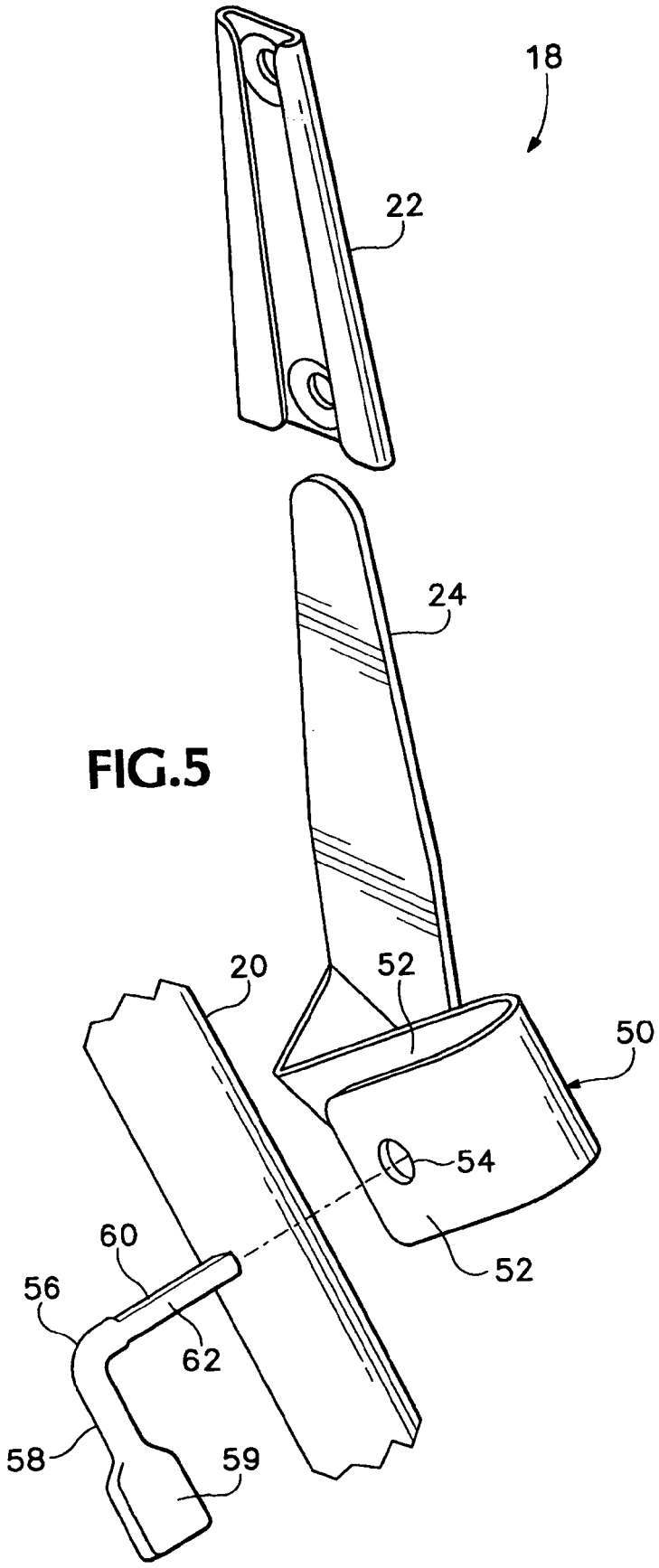
FIG. 5 is an isometric detail view showing the manner in which the mounting brackets depicted in FIG. 2 may be adjustably fastened to the display rack frame depicted in FIG. 1.
Figure 6:
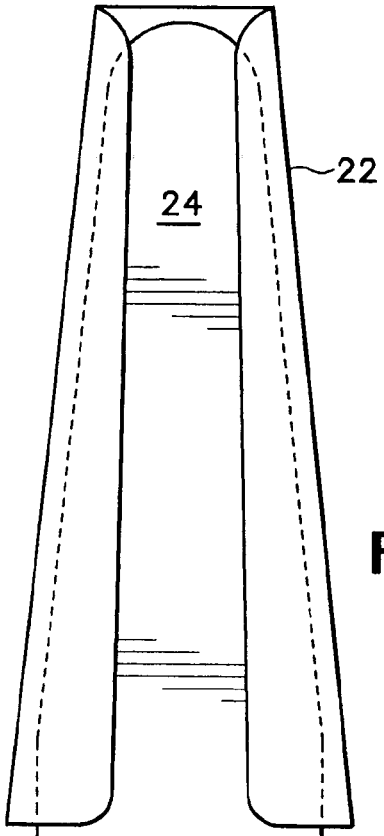
FIG. 6 is a side elevational view of the mounting bracket shown in FIG. 5 fastened to a part of the display rack frame depicted in FIG. 1, together with a socket portion of the back of a reclining chair.

Typically, recliner chairs are shipped from a factory disassembled and include sockets 22 that receive mating fingers that extend upward from the base portion of the recliner chair. With this in mind, the mounting brackets 18 include tapered upwardly directed mounting fingers 24 that resemble or duplicate those that are in the chair base portion, so that when the lateral arms 20 of the display rack 14 are spaced apart an appropriate distance 23, each similar chair back 16 may be secured to the display rack 14 by sliding the sockets 22 over the fingers 24, as shown in FIGS. 5 and 6. Because different brands or models of recliner chairs or other furniture items may have different sockets 22, different mounting brackets 18 for the inventory display rack 14 may include fingers having various shapes and sizes corresponding to a particular manufacturer's chairs, for example.

Figure 3:
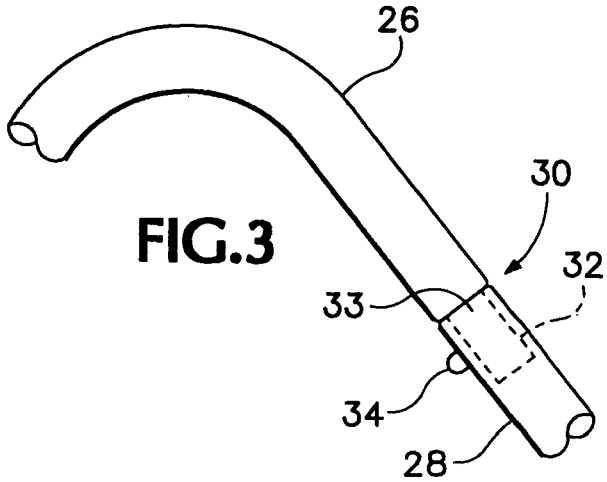
FIG. 3 is an isometric view of a section of the frame of the display rack depicted in FIG. 1, showing how its constituent parts may be fastened together.
Figure 4:
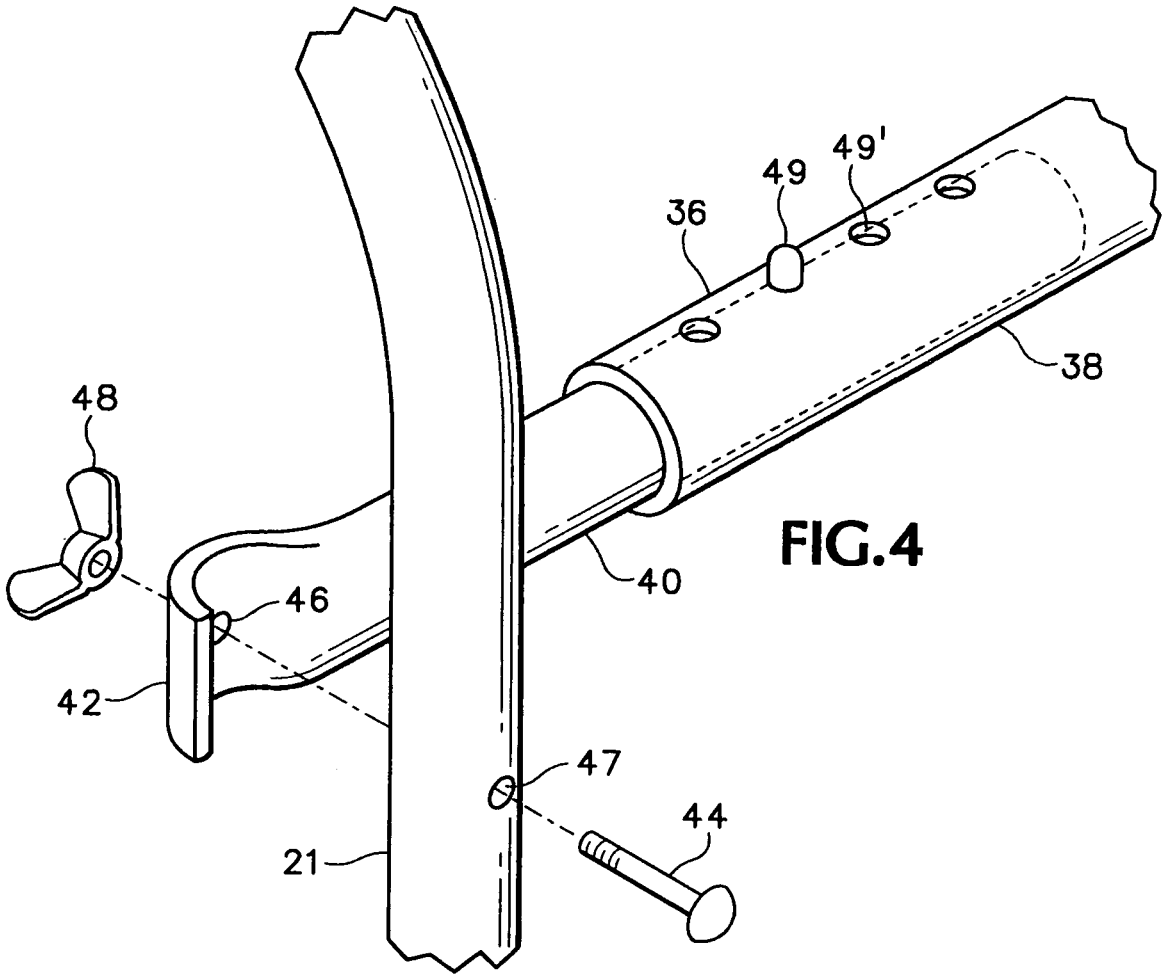
FIG. 4 is an isometric view of a section of the display rack depicted in FIG. 1 showing how a support arm is secured to the legs of the display rack frame depicted in FIG. 1.

Referring to FIGS. 2–4, the display rack 14 is preferably capable of being disassembled so that it can be stored efficiently while not in use, and assembled when needed. Each side of the frame 14 includes an upright rear portion 26 with a downwardly curved top, and a front portion 28 including the lateral arm 20 and lower leg 21. The front and rear portions 28 and 26 are preferably of thin-walled pipe and are interconnected by a joint 30, shown in FIG. 3. The joint 30 includes an end portion 32 of slightly reduced diameter that extends from the back member 26 to fit snugly within the open end 33 of the front member 28. A pin, or, more preferably, a spring-loaded round-topped detent plunger 34 mounted in the end portion 32 may then be used to secure the two members together. Alternative embodiments of the rack 14 may include other means for interconnecting and disassembling parts of the frame of the display rack 14, or the display rack 14 may instead include frame side members of unitary construction.

Support bars 36 are preferably attached to interconnect both the rear portions 26 and the front portions 28 of the display rack 14 and adjustably establish and control the spacing 23 between the lateral arms 20 before portions of disassembled inventory items are secured to the frame 14. Referring to FIGS. 2 and 4, a support bar 36 includes an outer sleeve member 38 slidably engaged around an elongate inner pipe member 40, both together forming the variable-length support bar 36. Respective flattened ends of the pipe member 40 and the sleeve member 38 define the outer ends 42 of the support bar 36 and are curved to fit matingly around a respective lower leg 21 or rear portion 26. The ends 42 of the support bar 36 are preferably fastened to the lower legs 21 or rear portions 26 by passing bolts 44 through respective aligned through-bores 46 and 47 defined in ends 42 and the respective lower leg 21 or rear portion 26 and securing each bolt 44 in place with a wing nut 48.

As can be seen, the sliding engagement of the inner pipe member 40 in the outer sleeve 38 allows the support bars 36 to be adjusted in length to accommodate similar chair backs 16 of a selected width, or similar portions of other disassembled items to be displayed. To prevent the outer sleeve member 38 and inner pipe member 40 of the support bar 36 from inadvertently sliding too far apart or becoming separated, the inner pipe 40 preferably includes a spring-loaded detent plunger 49 that will pop up into one of a series of aligned openings 49' defined in the outer sleeve 38 if the support bar 36 extends to one of several predetermined lengths. In one preferred embodiment of the inventory display rack 14, the configuration of the support bar 36 is such that the detent plunger 49 is normally in a depressed position within the outer sleeve 38, so that the distance 23 between the lower legs 21 or rear portions 26 may be adjusted as necessary to accommodate the items to be displayed. The detent plunger 49 will therefore act to prevent the frame 14 from expanding too much and thus will prevent the display rack 14 from falling apart.

Figure 10:
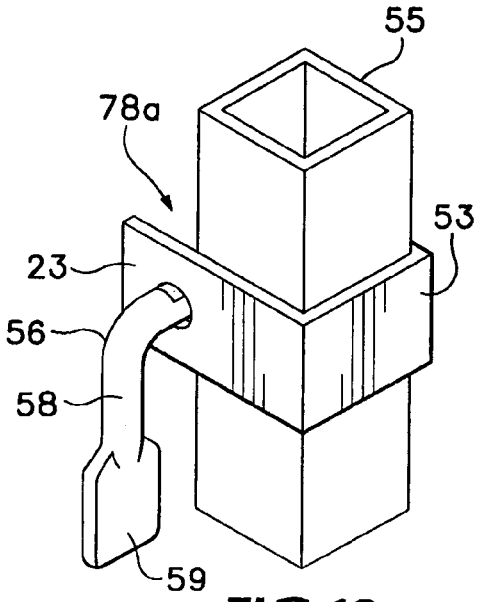

Referring to FIGS. 5 and 6, the inventory display rack 14 preferably includes mounting brackets 18 of pressed metal or other suitable construction that may be adjustably positioned at selected locations along a lateral arm 20 so as to mount portions of disassembled items of various dimensions on the display rack 14. The mounting brackets 18 are preferably shaped so they may be mounted on a respective lateral arm 20 at a desired location and locked into place, or may be slid along the lateral arm 20 to a new location and locked into place there. To allow the adjustable positioning of the mounting brackets 18 at any selected location along a lateral arm 20, the mounting bracket 18 includes a channel portion 50 that fits matingly around a selected one of the lateral arms 20. As shown in FIGS. 5 and 6, then, the channel portion 50 of each locking bracket 18 is U-shaped so that it can fit matingly, but slidably around a lateral arm 20 of a generally cylindrical shape and corresponding size. Other such display racks that have lateral arms 20 of different shapes may require a different shape for the channel portion 50. For example, FIG. 10 shows a mounting bracket 23 of another configuration wherein the channel portion 53 has a squared shape so that it may matingly engage a squared lateral arm 55 or similar structural member.

Figure 9:
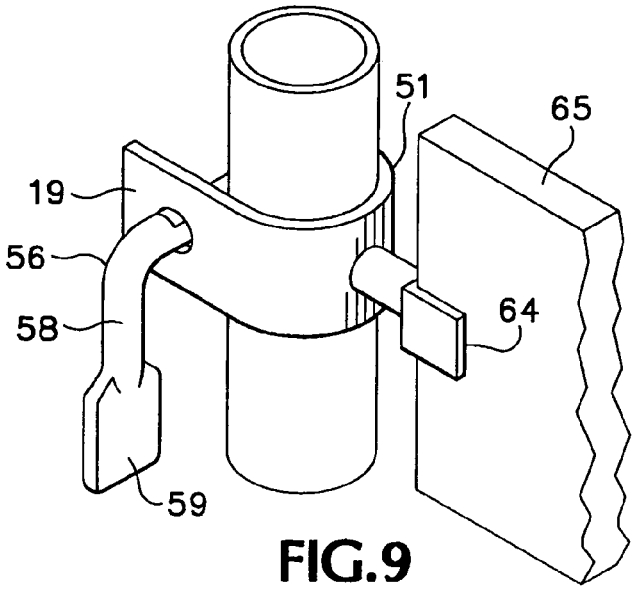
FIGS. 9–15 are isometric views of clamping and mounting brackets that are alternative embodiments of one aspect of the mounting bracket depicted in FIGS. 5–8.

In order to engage a side of a chair back 16 to support it on the display rack 14, the mounting bracket 18 includes an upwardly extending finger 24, which, as previously mentioned, is inserted into a socket 22 of a chair back 16. In a preferred embodiment of the bracket 18, the finger 24 is directed upwardly from a leg extending laterally from one of the side walls 52 of the channel portion 50. To support an item to be displayed between the side members of the frame of the display rack 14, the mounting brackets 18 are used in pairs each including a left handed bracket and a right handed bracket. Each finger 24 is thus spaced apart from the channel portion 50 and the lateral arms 20 so that the finger 24 may be inserted into the socket 22 easily and without being obstructed by adjacent parts of the chair back 16. Other embodiments of the mounting bracket may include other members instead of the finger 24. For example, FIG. 9 shows a mounting bracket 19 that includes a channel portion 51 and a laterally extending clamp portion 64 configured to be fastened to a generally planar portion 65 of an inventory item, such as a tabletop.

Once the mounting bracket 18 has been positioned at a desired location along a lateral arm 20, the mounting bracket 18 should be locked into place. To this end, the mounting bracket 18 includes a novel clamp mechanism that rigidly and securely affixes the mounting bracket 18 to a selected one of the lateral arms 20 in the desired position. Referring again to FIGS. 5 and 6, the channel portion 50 includes two opposed parallel side walls 52 that define a pair of aligned bores 54 through which an engagement member 56 extends, spanning the space between the side walls 52, while the channel portion 50 is matingly fitted around a selective one of the lateral arms 20. The engagement member 56 is preferably a cam in the form of a pin and may be manually rotated about a rotational axis 61 between a first, unlocked, position shown in FIG. 7 that allows the mounting bracket 18 to slide along the lateral arm 20 to a desired position, and a second, locked, position shown in FIG. 8 that rigidly secures the mounting bracket 18 to a lateral arm 20. Alternatively, the engagement member 56 may be removed from the channel portion 50 after the engagement member 20 is rotated to the unlocked position so that the mounting bracket 18 may more easily be removed and then placed in a new position and locked into place. The engagement member 56 may include an angled handle 58 to facilitate manual rotation of the engagement member 56 between the first, unlocked position and the second, locked, position. Additionally, the handle 58 may include a flattened portion 59 to facilitate rotation of the engagement member 56 by thumb or finger pressure.

Figure 8:
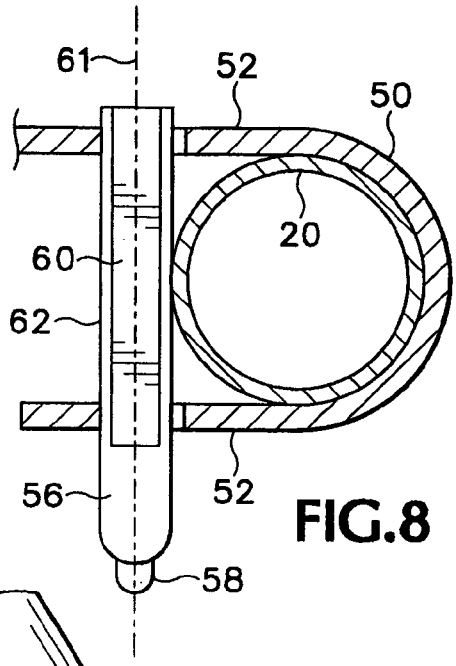
FIG. 8 is a sectional view taken along line 7—7 of FIG. 6 showing the mounting bracket depicted in FIG. 6 in a secured condition.
Figure 7:
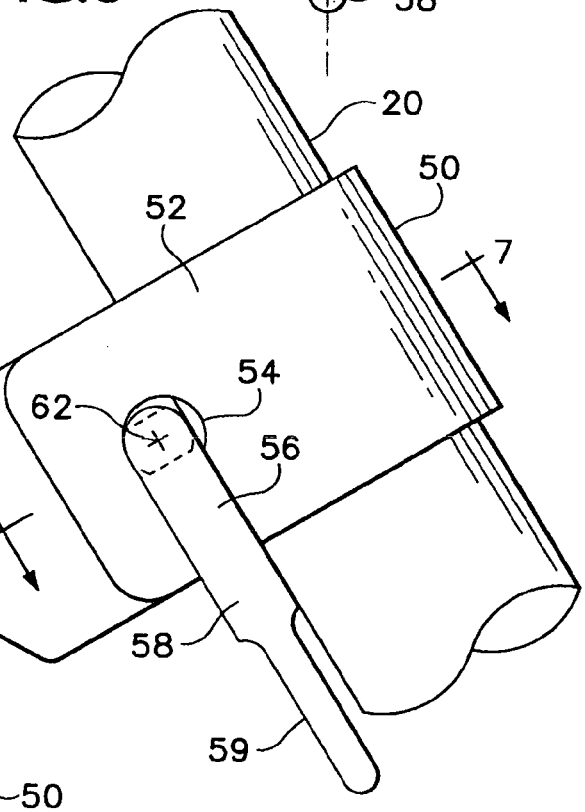
FIG. 7 is a sectional view taken along line 7—7 of FIG. 6 showing the mounting bracket depicted in FIG. 6 in an adjustable condition.
Figure 7:
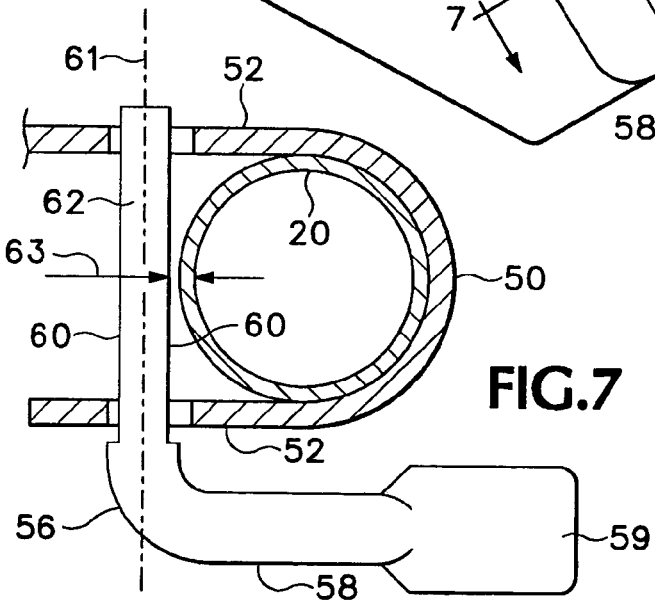

The engagement member 56 is generally cylindrical in shape but has at least one face 60 and at least one convexly curved locking cam surface 62. The face 60 may be flat. Alternatively, the face 60 may be concavely or convexly curved, so long as the face 60 has an outermost point closer to the axis 61 than the outermost point of the surface 62. The engagement member 56 can be made, for example, by pressing flats into opposite sides of round bar stock of an appropriate size, such as ⅜-inch diameter mild steel round stock. The opposite faces 60 are thus closer together than the resulting bulged curved surfaces 62. As can be seen in FIG. 7, when the engagement member 56 is rotated to its first, unlocked, position, one of the faces 60 is facing inward of the channel portion 50, towards the lateral arm 20, and there is sufficient clearance 63 between the face 60 of the engagement member 56 and the lateral arm 20 to allow the mounting bracket 18 to slide along the lateral arm to a desired position. Additionally, in this unlocked position, the engagement member 56 may be selectively inserted through, or removed from, the bores 54 in the side walls 52 of the channel portion 50 of the mounting bracket 18. Conversely, as can be seen in FIG. 8, when the engagement member 56 is present in the bores 54 and rotated to the second, locking, position, one of the convexly curved locking cam surfaces 62 is facing inward toward the lateral arm, and the engagement member 56 engages the lateral arm 20 and locks the mounting bracket 18 into place by pressing the lateral arm tightly into contact against the interior surface of the channel 50.

Figure 11:
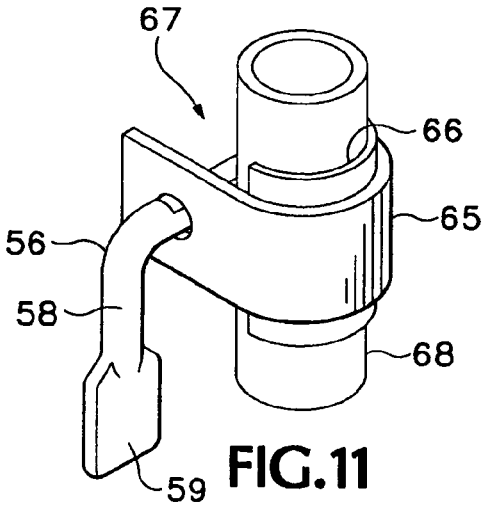

It should be understood that the clamping aspect of the mounting brackets 18 may be used in a variety of applications. Referring to FIG. 11, for example, the clamping mechanism of a bracket 67 may be used to secure a pipe patch 66 of sheet rubber between the channel portion 65 and a pipe 68 that may be leaking. When the engagement member 56 is rotated to the locked position, the bracket 67 acts to squeeze the pipe patch 66 and the pipe 68 together to prevent leakage.

Figure 12:
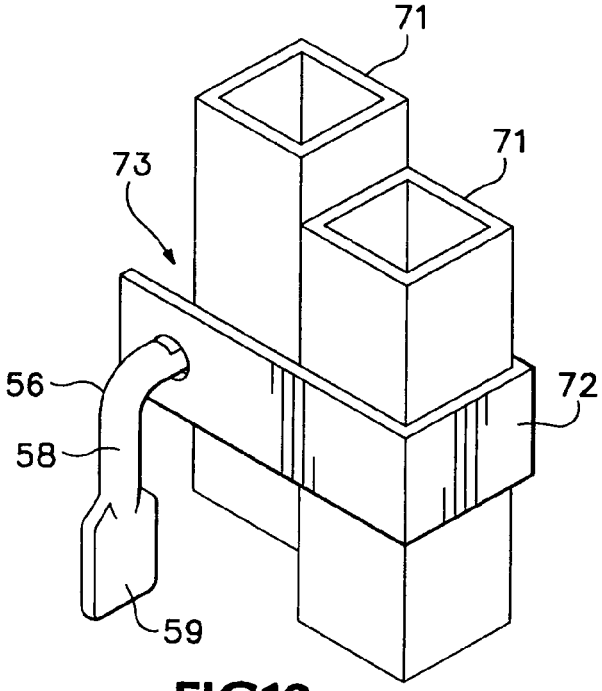
Figure 13:
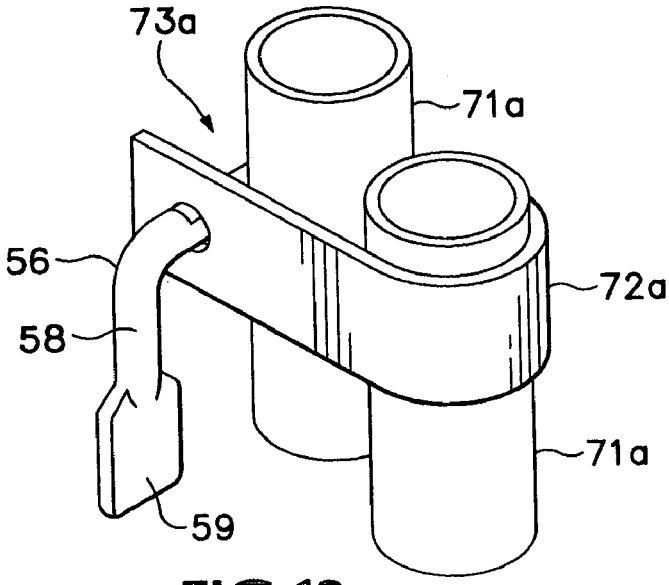

FIG. 12 shows another application of the bracket, in which a bracket 73 is used to rigidly secure two pipes 71 together. The channel portion 72 of the bracket 73 is square-shaped so that it mates with the shape of the pipes 71 to be secured. Referring to FIG. 13, in a bracket **73*a* used to clamp together two pipes 71*a* of a cylindrical shape, the channel portion 72*a*** has a rounded shape.

Figure 14:
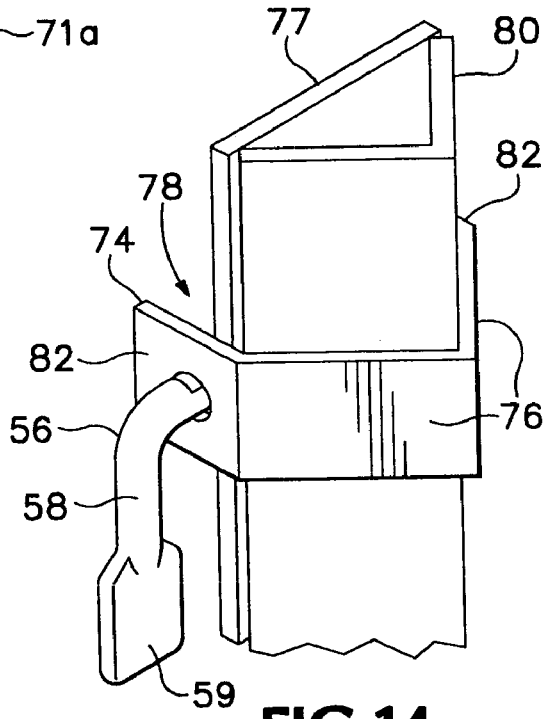
Figure 15:
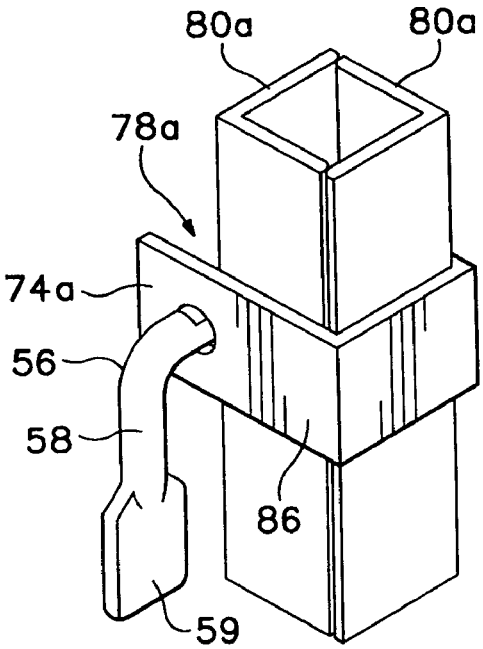

FIGS. 14 and 15 show yet another application of the clamping mechanism of a mounting bracket, which is another alternative embodiment of one aspect of the present invention. Referring to FIG. 14, a clamp 74 secures a planar member 77 to a short length of angle stock 80. In this instance, the clamp 74 has a channel portion 78 with inner side members 76 conjoined approximately at a right angle to each other. The bracket 74 also includes two opposed side walls 82 that each extend from a respective inner side member 76. The side walls 82 define respective coaxially aligned openings 84 through which the engagement member 56 may be inserted. Similarly, FIG. 15 shows a clamp **74*a* that is being used to hold two short lengths of angle stock 80*a* together, as to permit them to be welded together. In this instance, the channel portion 78*a* of the bracket 74*a* is square-shaped, and the two opposed side walls 86 extend a sufficient distance so that they can define respective coaxially aligned and appropriately located openings 84*a* for an engagement member 56**.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A clamp for adjustably securing a plurality of articles together, said clamp comprising:

(a) a channel capable of fitting about at least one of said articles having a pair of opposed sides defining an aligned pair of openings; and (b) an engagement pin extending through said openings and from one of said opposed sides to the other, said engagement pin being rotable within said openings, between a first, unlocked, position and a second, locking, position, said engagement pin having a first surface, facing into said channel when said engagement pin is in said first position and a convexly curved locking cam surface facing into said channel when said engagement pin is in said second position, wherein said first surface has an outer most point closer to a central axis of said pin than the outermost point of said convexly curved locking cam surface.

2. The clamp of claim 1 including a mounting finger supported by one of said opposed sides of said channel.

3. The clamp of claim 2 wherein said mounting finger is spaced apart from side channel by a leg attached to said one of said opposed sides.

4. The clamp of claim 1 wherein said engagement pin has a handle for manually rotating said engagement pin between said first position and said second position.

5. The clamp of claim 4 wherein said handle includes a flattened face to facilitate rotation of said engagement pin by thumb or finger pressure.

6. The clamp of claim 1 wherein said channel portion fits matingly about at least one of said articles.

7. The clamp of claim 1 wherein said channel portion fits matingly about a plurality of said articles.

8. The clamp of claim 1 wherein said channel has a bottom and wherein a laterally extending clamp portion is attached to said bottom.

* * * * *